US009038605B2

(12) United States Patent
Karim et al.

(10) Patent No.: US 9,038,605 B2
(45) Date of Patent: May 26, 2015

(54) PURGE VALVE NOISE ATTENUATION SYSTEM AND METHOD

(71) Applicant: Ford Global Technologies, LLC, Dearborn, MI (US)

(72) Inventors: Ahsanul Karim, Canton, MI (US); Abdelkrim Zouani, Canton, MI (US); Kevin William Plymale, Canton, MI (US); Paul Zeng, Inkster, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 352 days.

(21) Appl. No.: 13/622,982

(22) Filed: Sep. 19, 2012

(65) Prior Publication Data

US 2014/0076286 A1 Mar. 20, 2014

(51) Int. Cl.
*F02M 25/08* (2006.01)
*F02M 33/02* (2006.01)

(52) U.S. Cl.
CPC ... *F02M 25/0872* (2013.01); *F02M 2025/0845* (2013.01)

(58) Field of Classification Search
CPC ..... F02M 25/08; F02M 25/0836; F02M 25/0845; F02M 25/0872
USPC ..... 123/516, 518, 519, 520; 251/129.01, 251/129.15; 181/212, 213, 238
See application file for complete search history.

(56) References Cited

U.S. PATENT DOCUMENTS

| | | | | |
|---|---|---|---|---|
| 4,901,974 | A * | 2/1990 | Cook et al. | 251/129.15 |
| 5,014,746 | A | 5/1991 | Heymann | |
| 5,370,358 | A | 12/1994 | Hunter et al. | |
| 5,623,911 | A | 4/1997 | Kiyomiya et al. | |
| 6,439,540 | B1 | 8/2002 | Tse | |
| 6,505,646 | B1 * | 1/2003 | Singleton | 137/625.3 |
| 6,595,485 | B2 | 7/2003 | Burrola et al. | |
| 6,766,819 | B2 * | 7/2004 | Shost | 137/15.18 |
| 6,830,232 | B2 * | 12/2004 | Burrola et al. | 251/64 |
| 6,840,746 | B2 | 1/2005 | Marshall et al. | |
| 7,815,164 | B2 * | 10/2010 | Dong et al. | 251/121 |

FOREIGN PATENT DOCUMENTS

EP 0397058 A2 5/1990

* cited by examiner

*Primary Examiner* — Hai Huynh
(74) *Attorney, Agent, or Firm* — Julia Voutyras; Alleman Hall McCoy Russell & Tuttle LLP

(57) ABSTRACT

A vapor purge valve in an engine is provided. The vapor purge valve includes a purge valve inlet, a purge valve outlet, and a muffler including a housing at least partially enclosing a diffuser in fluidic communication with the purge valve inlet and the purge valve outlet.

20 Claims, 4 Drawing Sheets

PURGE VALVE NOISE ATTENUATION SYSTEM AND METHOD

FIELD

The present disclosure relates to a vapor purge system including a vapor purge valve dampening noise generated in the valve.

BACKGROUND AND SUMMARY

Vapor purge systems are used in engines to decrease emissions. Vapor purge systems may include a vapor purge canister in fluidic communication with an intake passage. Fuel vapor may build up in the purge canister during engine operation. A vapor purge valve may be used to implement purge operation and control transfer of fuel vapors from the purge canister to the intake manifold at desired operating conditions.

U.S. Pat. No. 6,595,485 discloses a purge valve having a dampening element between a plunger and an outlet tube. The dampening element reduces ticking noise generated during valve operation. Whether or not the purge valve disclosed in U.S. Pat. No. 6,595,485 reduces ticking noises from a purge valve, additional noises may be generated in the valve. Certain flow conditions in the purge valve may generate additional audible noises. For example, high turbulent kinetic energy may be generated in the purge valve during purge operation thereby generating undesirable sound waves which may be heard by the vehicle operator.

The Inventors herein have recognized the above issues and developed a vapor purge valve that can be positioned in an engine. The vapor purge valve includes a purge valve inlet, a purge valve outlet, and a muffler including a housing at least partially enclosing a diffuser in fluidic communication with the purge valve inlet and the purge valve outlet.

The muffler attenuates noises generated from purge gases traveling through the purge valve, decreasing the likelihood of a vehicle operator hearing noises from the purge valve. Specifically, in some examples, the muffler includes a noise attenuation chamber in fluidic communication with muffling passages opening into a diffuser passage included in the diffuser. As a result, turbulent kinetic energy in the gas flow through the diffuser is reduced, thereby decreasing audible noises generated by the vapor purge valve. Consequently, customer satisfaction may be increased. Furthermore, the configuration of the muffler described above does not significantly increase losses in the purge valve.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2, 3, and 4 are drawn approximately to scale, however other relative dimensions may be used if desired.

DETAILED DESCRIPTION

The following description relates to an approach for reducing noise generation in a vapor purge valve. The purge valve may include a muffler. The muffler may include a noise attenuation chamber and muffling passages enabling fluidic communication between a diffuser included in the muffler and the chamber. The muffling passages and the noise attenuation chamber enable turbulent kinetic energy in the gas flow through the diffuser to be reduced, thereby decreasing audible noise generated by the vapor purge valve. Consequently, customer satisfaction may be increased.

Figure 1:
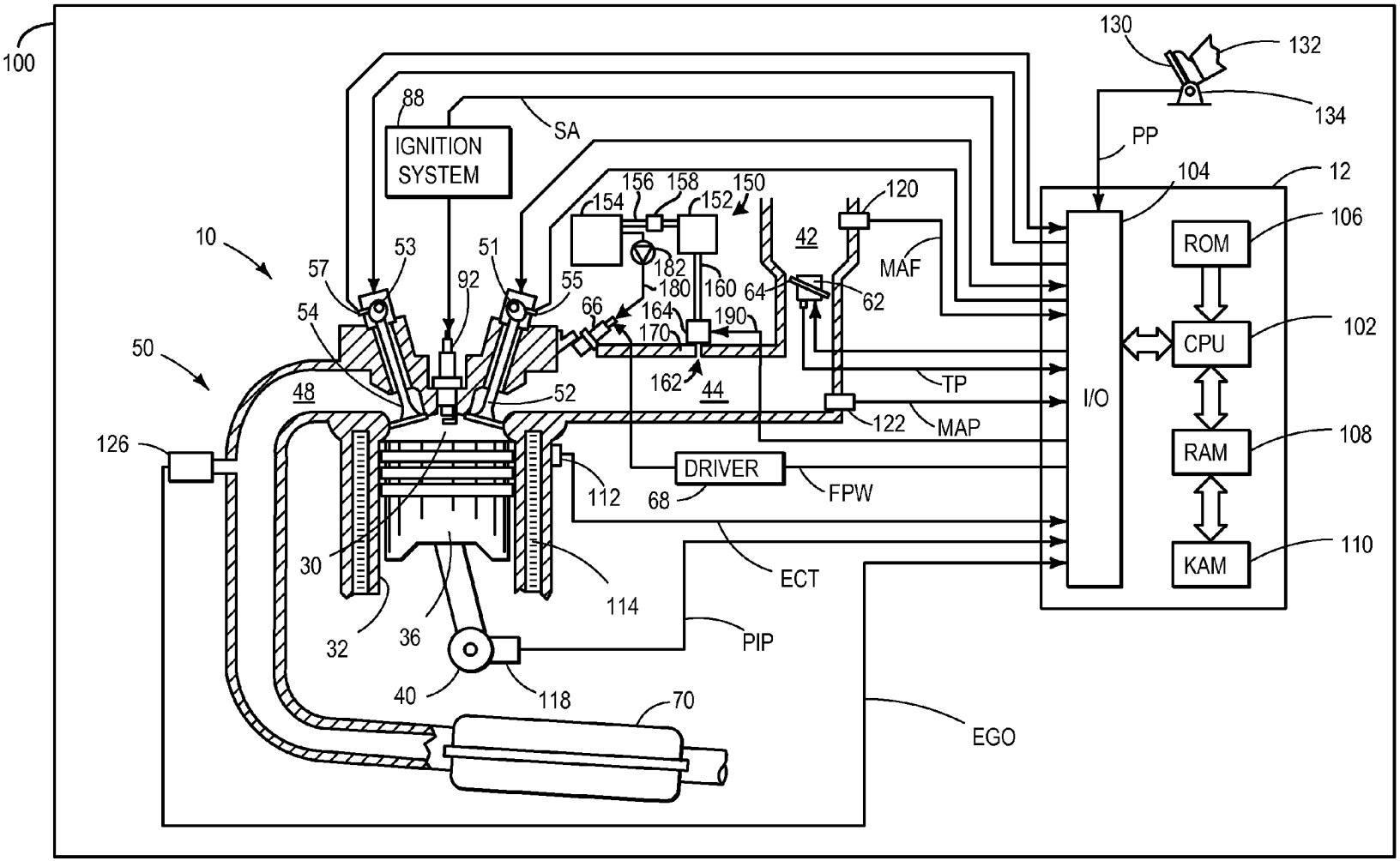
FIG. 1 shows a schematic depiction of an engine including a vapor purge system.
Figure 2:
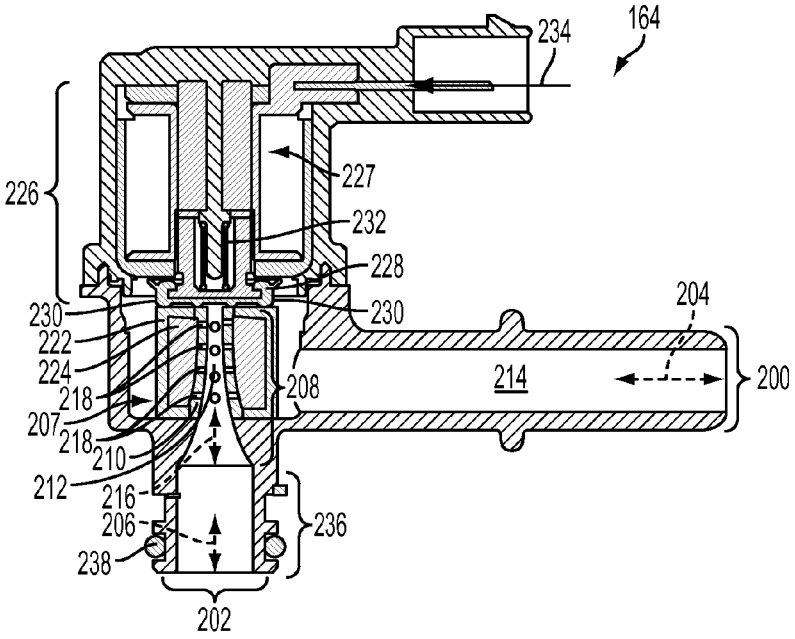
FIG. 2 shows an illustration of an example vapor purge valve included in the vapor purge system shown in FIG. 1.
Figure 3:
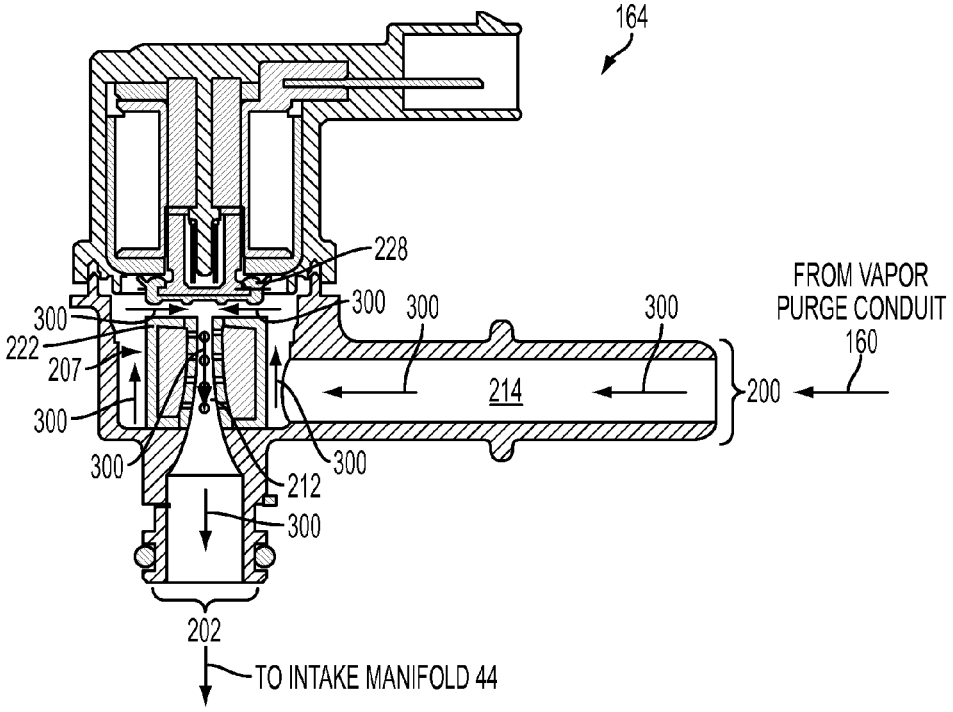
FIG. 3 shows a general direction of vapor gas flow in the purge valve shown in FIG. 2.
Figure 4:
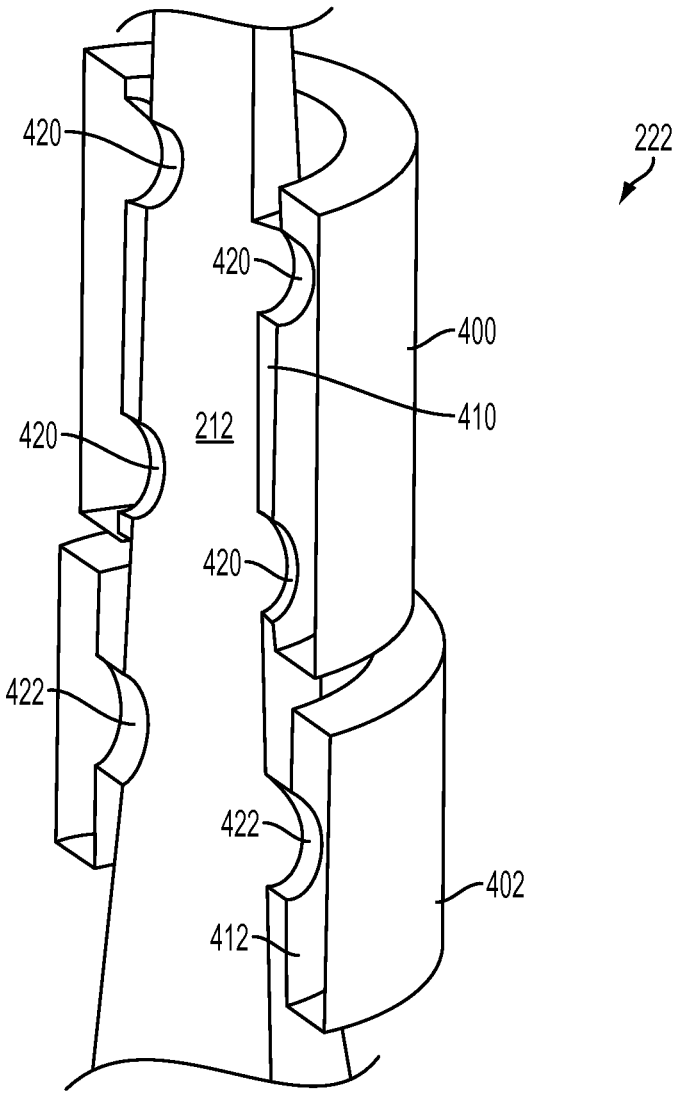
FIG. 4 shows a cross-sectional view of a muffler included in the vapor purge valve shown in FIG. 2.
Figure 5:
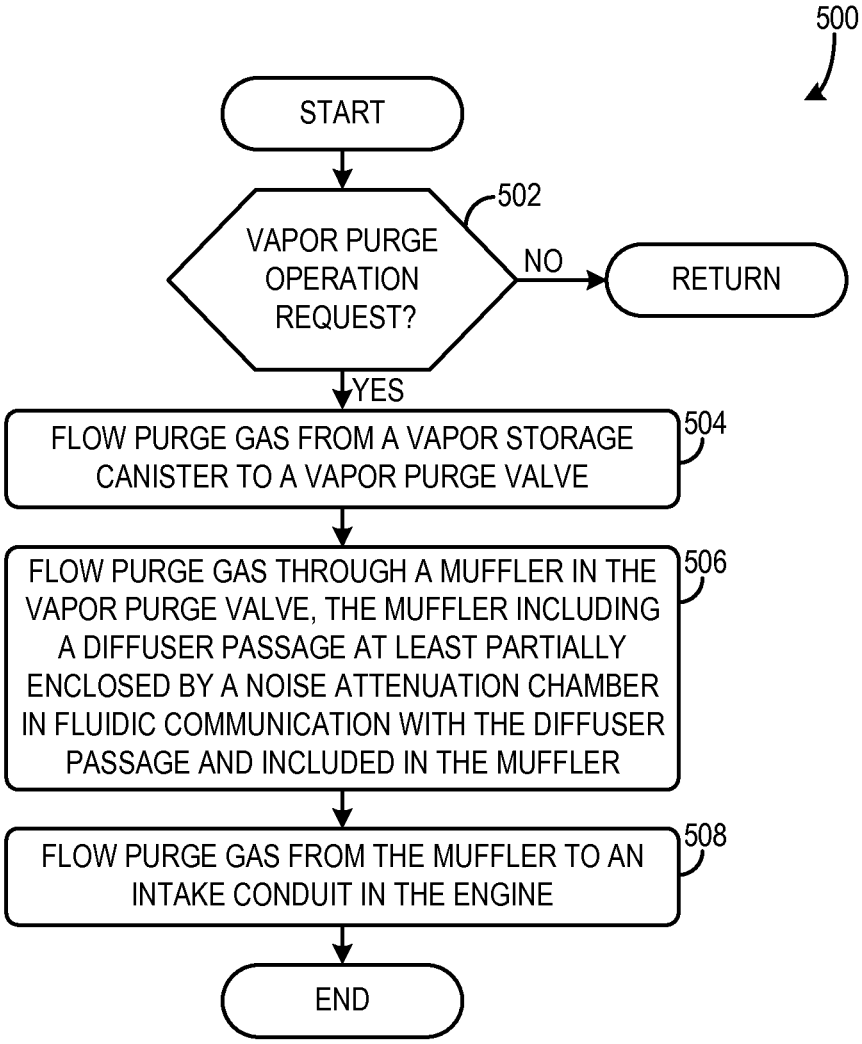
FIG. 5 shows a method for operation of a vapor purge system.

FIG. 1 shows a schematic depiction of an engine including a vapor purge system having a vapor purge valve. FIG. 2 shows an illustration of an example vapor purge valve. FIG. 3 shows the general direction of purge gas flow in the vapor purge valve shown in FIG. 2 during purge operation. FIG. 4 shows a detail illustration of an example diffuser and muffler included in the vapor purge valve shown in FIG. 2. FIG. 5 shows a method for purging vapors in an engine.

FIG. 1 is a schematic diagram showing one cylinder of multi-cylinder engine 10, which may be included in a propulsion system of a vehicle 100 in which an exhaust gas sensor 126 (e.g., air-fuel sensor) may be utilized to determine an air fuel ratio of exhaust gas produce by engine 10. The air fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Cylinder (i.e., combustion chamber) 30 of engine 10 may include combustion chamber walls 32 with piston 36 positioned therein. A cylinder head 80 is coupled to a cylinder block 82 to form the cylinder 30.

Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Cylinder 30 may receive intake air from intake manifold 44 via intake passage 42 and may exhaust combustion gases via exhaust passage 48. Intake manifold 44 and exhaust passage 48 can selectively communicate with cylinder 30 via respective intake valve 52 and exhaust valve 54. In some embodiments, cylinder 30 may include two or more intake valves and/or two or more exhaust valves. A throttle 62 including a throttle plate 64 is positioned in the intake passage 42. The throttle is configured to adjust the amount of airflow flowing to the cylinder 30.

In this example, intake valve 52 and exhaust valves 54 may be actuated via an intake cam 51 and an exhaust cam 53. In some examples, the engine 10 may include a variable cam timing system configured to adjust (advance or retard) cam timing. The position of intake valve 52 and exhaust valve 54 may be determined by position sensors 55 and 57, respectively.

Fuel injector 66 is shown arranged in intake manifold 44 in a configuration that provides what is known as port injection of fuel into the intake port upstream of cylinder 30. Fuel injector 66 may inject fuel in proportion to the pulse width of signal FPW received from controller 12 via electronic driver 68. In some examples, cylinder 30 may alternatively or additionally include a fuel injector coupled directly to cylinder 30 for injecting fuel directly therein, in a manner known as direct injection.

Ignition system 88 can provide an ignition spark to cylinder 30 via spark plug 92 in response to spark advance signal SA from controller 12, under select operating modes. Though spark ignition components are shown, in some examples, cylinder 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. In some examples, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some examples, emission control device 70 may be a first one of a plurality of emission control devices positioned in the exhaust system. In some examples, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory 106 (e.g., memory chip) in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

During operation, the cylinder 30 in the engine 10 typically undergoes a four stroke cycle: the cycle includes the intake stroke, compression stroke, expansion stroke, and exhaust stroke. In a multi-cylinder engine the four stroke cycle may be carried out in additional combustion chambers. During the intake stroke, generally, exhaust valve 54 closes and intake valve 52 opens. Air is introduced into cylinder 30 via an intake manifold, for example, and piston 36 moves to the bottom of the combustion chamber so as to increase the volume within cylinder 30. The position at which piston 36 is near the bottom of the combustion chamber and at the end of its stroke (e.g. when cylinder 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within cylinder 30. The point at which piston 36 is at the end of its stroke and closest to the cylinder head (e.g. when cylinder 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition devices such as a spark plug 92, resulting in combustion. Additionally or alternatively compression may be used to ignite the air/fuel mixture. During the expansion stroke, the expanding gases push piston 36 back to BDC. A crankshaft may convert piston movement into a rotational torque of the rotary shaft. Finally, during the exhaust stroke, exhaust valve 54 opens to release the combusted air-fuel mixture to an exhaust manifold and the piston returns to TDC. Note that the above is described merely as an example, and that intake and exhaust valve opening and/or closing timings may vary, such as to provide positive or negative valve overlap, late intake valve closing, or various other examples. Additionally or alternatively compression ignition may be implemented in the cylinder 30.

FIG. 1 also shows a vapor purge system 150 including a vapor storage canister 152. The vapor storage canister 152 may be in fluidic communication with a fuel tank 154. A vapor conduit 156 is in fluidic communication with the vapor storage canister 152 and the fuel tank 154. The vapor storage canister 152 may be a carbon canister including activated carbon which may be configured to absorb fuel vapors. It will be appreciated that the vapor storage canister 152 may receive and store fuel vapors during certain operating conditions. At a subsequent time, the stored vapors may be purged into the engine's intake system, discussed in greater detail herein. A vapor conduit 156 is coupled to the vapor storage canister 152 and the fuel tank 154. A valve 158 may be coupled to the vapor conduit 156. The valve 158 and the vapor conduit 156 may be included in the vapor purge system 150. The valve 158 may be configured to adjust the amount of gas flow through the vapor conduit 156. Therefore, the valve 158 may have an open configuration where gas including fuel vapor is allowed to flow through the vapor conduit 156 and a closed configuration in which gas is substantially inhibited from flowing through the vapor conduit 156. Additionally or alternatively, the vapor storage canister 152 may be in fluidic communication with a filler tube of the fuel tank 154. Therefore, in other examples the vapor storage canister 152 may be in fluidic communication with the filler tube and not the fuel tank. Furthermore, it will be appreciated that the vapor storage canister 152 may be in fluidic communication with additional sources of fuel vapor.

As shown, a vapor purge conduit 160 is in fluidic communication with the vapor storage canister 152 and the intake manifold 44. The vapor purge conduit 160 may be included in the vapor purge system 150. However, in other examples the purge conduit outlet 162 may be positioned upstream of the intake manifold 44. For example, the purge conduit outlet 162 may open into an intake conduit downstream of the throttle 62 and upstream of the intake manifold 44. Further in some examples, the purge conduit outlet 162 may open into an intake conduit downstream of a compressor in conjunction with a check valve, in some examples. The compressor may be configured to increase intake air pressure to provide boost to the engine 10.

A vapor purge valve 164 is coupled to the vapor purge conduit 160. Thus, the vapor purge valve and the vapor purge conduit may be fluidly communicating with the intake manifold 44 or other suitable intake conduit. The vapor purge valve 164 may be included in the vapor purge system 154. The vapor purge valve 164 is configured to adjust the amount of purge gas flow through the vapor purge conduit 160 from the vapor storage canister 152 to the intake manifold 44. The intake manifold 44 or other suitable intake passage may be included in the vapor purge system 150. The vapor purge valve 164 has an open configuration where purge gas flows through the valve from the vapor storage canister 152 to the intake manifold 44 or another suitable intake conduit. The vapor purge valve 164 may also have a closed configuration in which purge gas flow through the vapor purge conduit 160 is substantially inhibited. It will be appreciated that the vapor purge valve 164 may have a number of open configurations that enable different magnitudes of purge gas flow therethrough. The vapor purge valve 164 may be continuously or discretely adjustable in these open configurations. It will be appreciated that the intake manifold 44 or other suitable intake conduit may have vacuum pressure to enable fuel vapor to flow into the intake manifold, in some examples. Further in some examples, a fan may be used to increase the airflow between the vapor storage canister 152 and the intake manifold 44. A detailed view of the vapor purge valve 164 is shown in FIGS. 2 and 3, discussed in greater detail herein.

As shown, the vapor purge valve 164 is coupled to the intake manifold 44. However, in other examples the vapor purge valve 164 may be coupled to another suitable vapor purge conduit location. Further in some examples, the vapor purge valve 164 and the vapor purge conduit 160 may share a common outlet. That is to say, that the vapor purge valve 164 may be coupled to an outlet end of the vapor purge conduit. Therefore, the outlet of the vapor purge valve 164 may open into the intake manifold 44, in such an example. However, in other examples, the vapor purge valve 164 may be coupled to the vapor purge conduit 160 upstream of the outlet end of the vapor purge conduit. Additionally, the vapor purge valve 164 and/or vapor purge conduit 160 may extend through an intake manifold housing 170.

The controller 12 is in electronic communication with the vapor purge valve 164. A control signal is denoted via arrow 190. The controller 12 may be configured to implement purge operation based on the engine operating conditions. Therefore, the controller 12 may be configured to implement the vapor purge methods, techniques, routines, etc., discussed herein.

Additionally, the fuel tank 154 is in fluidic communication with the fuel injector 66 denoted via arrow 180. Specifically, the arrow 180 may denote a fuel line. As shown, a pump 182 is coupled to the fuel line 180. The pump 182 is configured to increase fuel pressure of the fuel in the fuel line. Additionally, a second fuel pump (e.g., higher pressure fuel pump) may also be provided in the fuel delivery system, if desired. In this way, fuel may be flowed from the fuel tank to the injector. The controller 12 may also be configured to adjust operation of the pump 182.

FIG. 2 shows an example vapor purge valve 164. The vapor purge valve 164 includes a purge valve inlet 200 in fluidic communication with the vapor storage canister 152, shown in FIG. 1, and a purge valve outlet 202 in fluidic communication with the intake manifold 44 or other suitable intake passage included in the engine 10, shown in FIG. 1. A central axis 204 of the purge valve inlet 200 is arranged at a perpendicular angle with respect to a central axis 206 of the purge valve outlet 202. However, other relative positions of the purge valve outlet and the purge valve inlet have been contemplated. For example, the angle between the central axes may be less than or greater than 90°.

The vapor purge valve 164 further includes a muffler 207. The muffler includes a diffuser 208 in fluidic communication with the purge valve inlet 200 and the purge valve outlet 202. The diffuser 208 includes a diffuser housing 210 defining a boundary of a diffuser passage 212. Therefore, the diffuser housing 210 and the diffuser passage 212 are included in the muffler 207. It will be appreciated that purge gas may flow through the purge valve inlet 200, through an inlet passages 214, and into the diffuser 208 of the muffler 207, during some operating conditions (e.g., when purge operation is desired). The purge gas may then flow from the diffuser 208 into the purge valve outlet 202. A portion of the inlet passage 214 at least partially surrounds the muffler 207, discussed in greater detail herein. However, other inlet passages geometries have been contemplated. Therefore, when the purge valve is in an open configuration purge gas may enter the muffler from the inlet passage in fluidic communication with the purge valve inlet, flow through the diffuser included in the muffler, and exits the muffler in the purge valve outlet, the inlet passage at least partially enclosing the muffler.

The cross-sectional area of the diffuser passage 212 perpendicular to a central axis 216 of the diffuser passage increases in cross-sectional area in a downstream direction. Specifically, the cross-sectional area increases in a non-linear manner. However, other diffuser passages geometries have been contemplated. For example, the diffuser passage 212 may be cylindrical or conical.

Muffling passages 218 included in the muffler 207 extend through the diffuser housing 210. The muffling passages 218 may be cylindrical. However, other muffling passage geometries have been contemplated. As shown, each of the muffling passages 218 has a substantially constant cross-sectional area (e.g., diameter) along its length. The cross-sectional area is perpendicular to a central axis of the muffling passage. Therefore, the muffling passages 218 are cylindrical in the depicted example. However, in other examples, the muffling passages 218 may be conical. The muffling passages 218 are also depicted as being radially aligned. However, other muffling passage alignments have been contemplated. Additionally, the length of the muffling passages 218 increases in a downstream direction in the depicted example.

The muffler 207 may be configured to reduce noises generated in the vapor purge valve. Specifically, the muffler 207 may reduce the turbulent kinetic energy of the gas flow through the diffuser passage 212, thereby reducing noise generated in the vapor purge valve. As shown, the muffler 207 is integrated in the vapor purge valve which decreases the profile of the vapor purge valve, thereby increasing the compactness of the vapor purge system. The weight of the vapor purge valve may also be reduced when the muffing device is integrated therein. The muffler 207 includes a muffler housing 222. The muffler housing 222 encloses and/or surrounds an upstream portion of the diffuser 208 having the muffling passages 218 extending therethrough. However, in other examples the muffler housing 222 may enclose the entire diffuser 208.

The muffler 207 further includes a noise attenuation chamber 224. A portion of the boundary of the noise attenuation chamber 224 is defined by an inner periphery of the muffler housing 222 an outer periphery of the diffuser housing 210. The noise attenuation chamber 224 may be annular, in some examples. However other chamber shapes have been contemplated. Another portion of the boundary of the noise attenuation chamber 224 is defined by an outer periphery of the diffuser housing 210. Additionally, the noise attenuation chamber 224 may be hollow. However, in other examples the noise attenuation chamber 224 may be filled with foam and/or another suitable sound absorption material. It will be appreciated that the noise attenuation chamber 224 at least partially encloses and/or surrounds the diffuser 208. Furthermore, the noise attenuation chamber 224 is in fluidic communication through the muffling passages 218, and with the diffuser passage 212. Specifically, the muffling passages 218 may open into the noise attenuation chamber 224.

It will be appreciated that sound waves (e.g., audible sound waves) generated in the vapor purge valve 164 may travel into the noise attenuation chamber 224. The noise attenuation chamber 224 is configured to attenuate the sound waves to decrease the noise in the purge valve. As a result, the likelihood of a vehicle operation hearing noises generated by the vapor purge valve is reduced thereby increasing customer satisfaction. Specifically in some examples the muffler may attenuate noises (e.g., dithering noises) above 1,500 hertz (Hz). However, other frequency ranges may be attenuated if desired. The size, shape, and/or distribution of muffling passage 218 and/or noise attenuation chamber 224 may be adjusted based on a desired attenuated frequency or frequency range, if desired.

The vapor purge valve 164 further includes an actuation assembly 226. Specifically, in the depicted example the actuation assembly 226 is an armature assembly and the vapor purge valve 164 is a solenoid type valve. Therefore, the actuation assembly 226 includes a solenoid 227 in FIG. 2. However, other vapor purge valve configurations have been contemplated. The actuation assembly 226 includes an actuation assembly seal 228. The actuation assembly seal 228 is configured to substantially inhibit purge gas flow into the diffuser passage 212 in a closed configuration. Thus, in the closed configuration that actuation assembly seal 228 is in direct contact with an outer portion of the muffler housing 222. In this way, the actuation assembly seal 228 may inhibit flow into a diffuser inlet when the vapor purge valve 164 is in a closed configuration. However, in an open configuration the actuation assembly seal 228 may move away from the muffler housing 222 to enable gas flow through the diffuser 208. Therefore, in an open configuration the actuation assembly seal 228 may be spaced away from the muffler housing 222. Additionally, the muffler housing 222 extends to a radial edge 230 of an actuation assembly seal 228, in the depicted example.

The muffler housing 222 may comprise a different material than the diffuser housing 210. For example, the muffler housing may comprise metal (e.g., steel) and the diffuser housing 210 may comprise a polymeric material or vice-versa. The actuation assembly 226 also includes a spring 232. Furthermore, the actuation assembly 226 may be in electronic communication with the controller 12, shown in FIG. 1 denoted via arrow 234. The vapor purge valve 164 may also include a downstream body 236 including an o-ring 238. The o-ring 238 may be in face sharing contact with the intake manifold housing 170, shown in FIG. 1, in some examples.

FIG. 3 shows the general direction of purge gas flow in the purge valve 164 during purge operation. The purge valve 164 shown in FIG. 3 is in an open configuration and the purge valve 164, shown in FIG. 2 is in a closed configuration. Continuing with FIG. 3, arrows 300 depict the general direction of purge gas flow in the purge valve 164. It will be appreciated that during purge operation purge gas flows from the vapor storage canister 152, shown in FIG. 1, into the purge valve inlet 200 included in the purge valve 164. From the purge valve inlet 200 the purge gas flows through the inlet passage 214. From the inlet passage 214 the purge gas flows into the diffuser passage 212 in the muffler 207. As shown, the inlet passage 214 at least partially surrounds the muffler 207. Therefore, the purge gas may flow around the muffler 207 before entering the inlet of the muffler. When the purge valve 164 is in the open configuration the actuation assembly seal 228 is spaced away from the muffler housing 222. In this way, purge gas is allowed to flow into the diffuser passage 212 from the inlet passage 214. It will be appreciated that sound waves generated in the purge valve 164 may be dampened by the muffler 207, thereby reducing the audible nose emanated from the valve. From the diffuser passage 212 purge gas then flows into the downstream body 236 and into the purge valve outlet 202. From the purge valve outlet 204 the purge gas flows into the intake manifold 44, shown in FIG. 1, or another suitable intake passages in the engine. It will be appreciated that the purge gas flow may have additional complexity that is not depicted in FIG. 3.

FIG. 4 shows a cross-sectional view of the diffuser 208 and a section of the muffler 207. As shown, the muffler housing 222 includes an upstream section 400 and a downstream section 402. However, in other examples, the muffler housing 222 may form a continuous piece of material. The upstream section 400 defines a portion of a boundary of an upstream noise attenuation chamber 410 and the downstream section 402 defines a portion of a boundary of a downstream noise attenuation chamber 412. The upstream noise attenuation chamber 410 may be fluidly separated from the downstream noise attenuation chamber 412. However, in other examples the noise attenuation chambers may be in direct fluidic communication.

The upstream section 400 and the downstream section 402 are substantially cylindrical. Two sets 420 of radially opposing muffling passages are in fluidic communication with the upstream noise attenuation chamber 410 and the diffuser passage 212. A single set 422 of radially opposing muffling passages are in fluidic communication with the downstream noise attenuation chamber 412 and the diffuser passage 212. In this way, at least two of the muffling passages extend in opposing directions.

It will be appreciated that the muffler 207 design described above may not substantially impact purge gas flow though the vapor purge valve 164. In this way, noise dampening may be provided without affecting purge operation. Each of the muffling passages in the aforementioned sets of muffling passages shown in FIG. 4 may have an equivalent diameter (e.g., 1.2 millimeters (mm)). The outer diameter of the upstream muffler housing may be 6 mm and the outer diameter of the downstream muffler housing 222 may be 7 mm. The axial length of the upstream muffler housing 222 may be 5.25 mm. The axial length of the downstream muffler housing 222 may be 3.4 mm. The axial separation between the upstream muffler housing 222 and the downstream muffler housing 222 may be 0.75 mm. However, other muffler dimensions have been contemplated. In some examples, the size of the muffling passages may increase or decrease in a downstream direction.

FIG. 5 shows a method 500 for operation of a vapor purge system. The method 400 may be implemented via the engine, systems, components, etc., described above with regard to FIGS. 1-4 or may be implemented via other suitable engines, systems, components, etc.

At 502 it is determined if vapor purge operation is requested by a controller. If it is determined that vapor purge operation is not request (NO at 502) the method may return to the start. However, if it is determined that vapor purge operation is requested (YES at 502) the method includes at 504 flowing purge gas from a vapor storage canister to a vapor purge valve. Next at 506 the method includes flowing purge gas through a muffler in the vapor purge valve, the muffler including a diffuser passage at least partially enclosed by a noise attenuation chamber in fluidic communication with the diffuser passage and included in the muffler. At 508 the method includes flowing purge gas from the muffler to an intake conduit in the engine. It will be appreciated that steps 504, 506, and/or 508 may be implemented during idle engine operation when engine speed is below a threshold value, in some examples. Method 500 enables noises in a purge valve may be attenuated during purge operation, thereby reducing the likelihood of a vehicle operation hearing the purge valve noise. As a result, customer satisfaction may be increased.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vapor purge valve comprising:

a purge valve inlet;

a purge valve outlet;

an actuable seal; and a muffler including a housing enclosing a diffuser except for a diffuser inlet in fluidic communication with the purge valve inlet and a diffuser outlet in fluidic communication with the purge valve outlet, the diffuser inlet axially aligned with the diffuser outlet, the actuatable seal closing the purge valve by sealing with the diffuser inlet and the housing.

2. The vapor purge valve of claim 1, where the diffuser includes a diffuser housing defining a boundary of a diffuser passage and a plurality of muffling passages extending through the diffuser housing.

3. The vapor purge valve of claim 2, where the plurality of muffling passages are radially aligned.

4. The vapor purge valve of claim 2, where at least two of the plurality of muffling passages extend in opposing directions, and wherein the diffuser housing includes a first upstream diffuser housing section defining an upstream chamber separated from a second downstream diffuser housing section defining a separate, downstream chamber, each chamber radially outside of the diffuser passage.

5. The vapor purge valve of claim 2, where a cross-sectional area of each of the plurality of muffling passages is substantially constant along their length.

6. The vapor purge valve of claim 2, where the muffler includes a noise attenuation chamber enclosed by the muffler housing, the plurality of muffling passages in fluidic communication with the noise attenuation chamber.

7. The vapor purge valve of claim 6, where the noise attenuation chamber is hollow.

8. The vapor purge valve of claim 6, where the noise attenuation chamber comprises metal or a polymeric material.

9. The vapor purge valve of claim 6, where the noise attenuation chamber surrounds at least a portion of the diffuser, and wherein the diffuser passage has a central axis, and wherein a cross-sectional area of the diffuser passage perpendicular to the central axis increases in cross-sectional area in a downstream direction.

10. The vapor purge valve of claim 2, where the muffler housing comprises a different material than the diffuser housing.

11. The vapor purge valve of claim 1, where a central axis of the purge valve inlet and a central axis of the purge valve outlet are arranged perpendicular with respect to one another, and where the muffler is positioned between an actuation assembly seal and the purge valve outlet, the actuation assembly seal coupled to a solenoid.

12. The vapor purge valve of claim 1, where purge flow enters the muffler from an inlet passage in fluidic communication with the purge valve inlet, flows through the diffuser included in the muffler, and exits the muffler in the purge valve outlet, the inlet passage at least partially enclosing the muffler.

13. The vapor purge valve of claim 12, where a portion of the muffler housing is in contact with an actuation assembly seal when the vapor purge valve is in a closed configuration.

14. A system, comprising:

a vapor storage canister;

a vapor purge valve, including a purge valve inlet in fluidic communication with the vapor storage canister and a muffler including a noise attenuation chamber in fluidic communication via holes with a diffuser passage, the diffuser passage in fluidic communication with a purge valve outlet and the purge valve inlet, the muffler having a housing enclosing the noise attenuation chamber, the purge valve further having a movable seal engaging with the housing to close the purge valve; and an intake passage in fluidic communication with the purge valve outlet.

15. The system of claim 14, where the muffler housing defines a boundary of the noise attenuation chamber, and a cross-sectional area of the diffuser passage perpendicular its central axis increases non-linearly in a downstream direction.

16. The system of claim 15, where the muffler housing extends to a radial edge of an actuation assembly seal inhibiting flow into the diffuser inlet when the vapor purge valve is in a closed configuration.

17. The system of claim 14, where the muffler further comprises a plurality of muffling passages extending through a diffuser housing defining a boundary of the diffuser passage, the plurality of muffling passages in fluidic communication with the diffuser passage and the noise attenuation chamber.

18. The system of claim 17, where the plurality of muffling passages are radially aligned.

19. A method for purging fuel vapors in an engine comprising:

flowing purge gas through a central diffuser passage of a muffler in a vapor purge valve via a seal spaced away from a muffler housing, the diffuser passage enclosed by a noise attenuation chamber except for a diffuser passage inlet and outlet, the noise attenuation chamber in fluidic communication with the diffuser passage via holes, the noise attenuation chamber fully enclosed by the muffler housing except for the holes; and flowing purge gas from the muffler to an intake conduit in the engine.

20. The method of claim 19, where flowing purge gas through the muffler is implemented during idle engine operation when engine speed is below a threshold value.

* * * * *